US005554041A

United States Patent [19]

Lallement

[11] Patent Number: 5,554,041

[45] Date of Patent: Sep. 10, 1996

[54] ELECTRICAL CONNECTION DEVICE WITH AUTOMATIC POSITIONING

[75] Inventor: Rëgis Lallement, Cestas, France

[73] Assignee: Lectra Systemes, S.A., Cestas Cedex, France

[21] Appl. No.: 392,825

[22] PCT Filed: Aug. 4, 1993

[86] PCT No.: PCT/FR93/00790

§ 371 Date: Feb. 28, 1995

§ 102(e) Date: Feb. 28, 1995

[87] PCT Pub. No.: WO94/06176

PCT Pub. Date: Mar. 17, 1994

[30] Foreign Application Priority Data

Sep. 1, 1992 [FR] France ..... 92 10452

[51] Int. Cl.[6] ..... H01R 13/64

[52] U.S. Cl. ..... 439/248; 439/247

[58] Field of Search ..... 439/248, 247, 439/378, 246, 310

[56] References Cited

U.S. PATENT DOCUMENTS

| | | | |
|---|---|---|---|
| 3,495,206 | 2/1970 | Pfister . | |
| 4,917,619 | 4/1990 | Nishiwaki | 439/248 X |
| 5,120,243 | 6/1992 | Mee | 439/248 X |
| 5,167,520 | 12/1992 | Henry et al. | 439/248 X |
| 5,392,371 | 2/1995 | Morlion et al. | 439/248 X |

FOREIGN PATENT DOCUMENTS

| | | |
|---|---|---|
| 0328178 | 8/1989 | European Pat. Off. . |
| 0441477 | 8/1991 | European Pat. Off. . |
| 4132889 | 4/1992 | Germany . |

*Primary Examiner*—P. Austin Bradley
*Assistant Examiner*—Daniel Wittels
*Attorney, Agent, or Firm*—Jones & Askew

[57] ABSTRACT

The invention relates to an electrical connection device with automatic positioning. The device comprises a first moving carriage (44) displaceable in a connection direction (C); a second carriage (48) mounted on the first carriage and movable relative thereto in a direction orthogonal to the connection direction (C); an indexer element (64) secured to the second carriage extending along the connection direction, the first connection element (34) being secured to the second carriage; and a stationary assembly forming a cam (72) for the indexer element, the second connection element being secured to the cam-forming assembly.

9 Claims, 2 Drawing Sheets

ELECTRICAL CONNECTION DEVICE WITH AUTOMATIC POSITIONING

The invention relates to an electrical connection device with automatic positioning.

More precisely, the invention relates to an electrical connection device in which it is possible to compensate automatically and without manual intervention for possible misalignment between the male connection element and the female connection element.

There exist numerous circumstances in which it is desired to establish an electrical connection by engagement of a male connection element with a female connection element, one of the elements being mounted on a stationary device while the other element is mounted on a moving device that is brought face to face with the first device to enable connection to be made. When the second device is displaced manually, then it is possible to put the two connection elements accurately into alignment. In contrast, when the displacement is remotely controlled, then it is very difficult to guarantee that the two connection elements are accurately positioned. This can give rise to it being impossible to make the connection or to a high risk that one of the connection elements will be damaged when the two elements of the electrical connection are engaged with each other.

Such a problem can arise in installations for cutting piles of sheets of textile material. Accompanying FIGS. 1 and 2 show such an installation. The installation comprises a certain number of stationary tables 10, 12 which are in alignment and on which the sheets of textile material that are to be cut are spread out and stacked. The stacks of sheets are cut by a cutting assembly 14 which essentially comprises a cutting head 16 mounted for X and Y movement, e.g. by means of a moving gantry 18.

In order to reduce the overall cost of an installation and in order to optimize utilization thereof, it is advantageous to provide a single cutting machine 14 that works with a plurality of tables 10, 12, etc. It is clear that the cutting machine is much more expensive than a spreading table. Optimization is achieved by using one or more independent spreading tables for preparing a series of stacks that are fed continuously to the cutting machine while the stacking table which has been used is temporarily associated with the cutting machine and remains stationary during cutting. For that purpose, the cutting machine 14 is mounted on rails 20, 22 which enable it to be displaced automatically so as to be brought successively up to each of the spreading tables 10, 12, etc. However, to transfer the stacks of sheets from the tables 10, 12 onto the cutting machine 14, it is necessary to control operations both on the tables 10, 12 and on the cutting machine 14, in particular the starting up of conveyor systems, so as to allow a stack of sheets to be transferred from a table 10, 12 until the cutting machine 14. It is thus necessary to synchronize the operation of members associated with the tables 10, 12 with the operation of members belonging to the cutting machine 14. Such synchronization requires electrical signals to be interchanged between the tables 10, 12 and the machine 14. Clearly one solution would consist in establishing flexible and permanent electrical links by means of cables between the machine 14 and each of the tables 10, 12, nevertheless, it will be understood that if the number of tables is large and if the distances to be travelled by the cutter are long, then such a solution is difficult to implement.

A solution therefore consists in providing respective male and female connection elements on the cutter 14 and on the tables 10, 12, etc., and in interconnecting said elements successively each time the cutting machine 14 comes up to one of the tables 10, 12. However, it will be understood that whatever the accuracy with which the cutting machine 14 may be displaced automatically along the rails 20, 22, positioning cannot be sufficiently accurate to ensure optimum conditions for mutually engaging the connection elements.

An object of the present invention is to provide an electrical connection device with automatic positioning that makes it possible without manual intervention to compensate for possible misalignment between male and female connection elements in order to ensure optimum conditions for mutual engagement of the two connection elements.

Another object consists in enabling the cutting machine and the spreading table to operate automatically and synchronously.

This ensures that operator action is not required on the spreading table in order to transfer a stack, with stack transfer being controlled directly by the cutting machine by means of an electrical connector or of a switch.

To achieve this object, the present invention provides an electrical connection device with automatic positioning, the device comprising first and second electrical connection elements, connection being obtained by engaging one of the elements in the other by relative displacement along a connection direction, the device being characterized in that it further comprises:

- a first moving support displaceable along the connection direction;
- a second support mounted on the first support and movable relative thereto along an adjustment direction which is orthogonal to the connection direction;
- an indexer element secured to said second support, extending along the connection direction, and having an indexing end, said first connection element being secured to said second support; and
- a cam-forming assembly suitable for co-operating with the indexing end of said indexer element, said second connection element being secured to said cam-forming assembly, whereby during displacement of the first moving support, co-operation between the indexer element and the cam-forming assembly causes said second support to be displaced relative to the first support until said first connection element is properly positioned relative to the second connection element.

It will be understood that with such a connection device, during displacement of the moving connection element, the indexer element co-operates with the cam-forming assembly and causes the position of the second moving support to be adjusted, thereby adjusting the position of the moving connection element which can then engage with the stationary connection elements under optimum conditions.

Preferably, the second support is movably mounted on the first support via resilient return means tending to maintain said second support in a predetermined position when said indexer element and said cam-forming element are not in contact.

It will be understood that a reference position for the moving connection element is thus defined. It is from this reference position that the two connection elements are brought into alignment during the displacements of the moving connection element.

Other characteristics and advantages of the invention appear more clearly on reading the following description of an embodiment of the invention given by way of non-limiting example. The description refers to the accompanying drawings, in which:

FIG. 1, as described above, shows an installation for cutting stacks of sheets, as seen from above;

FIG. 2, as described above, is a side elevation view of the FIG. 1 installation;

Figure 1:
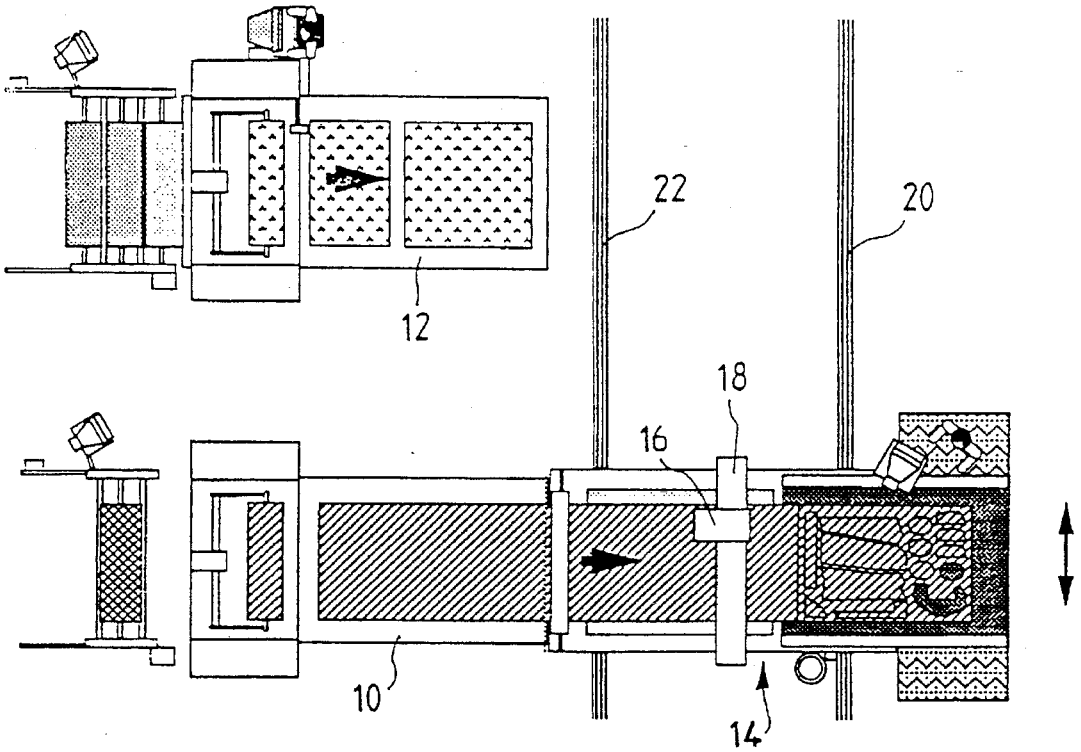
Figure 2:
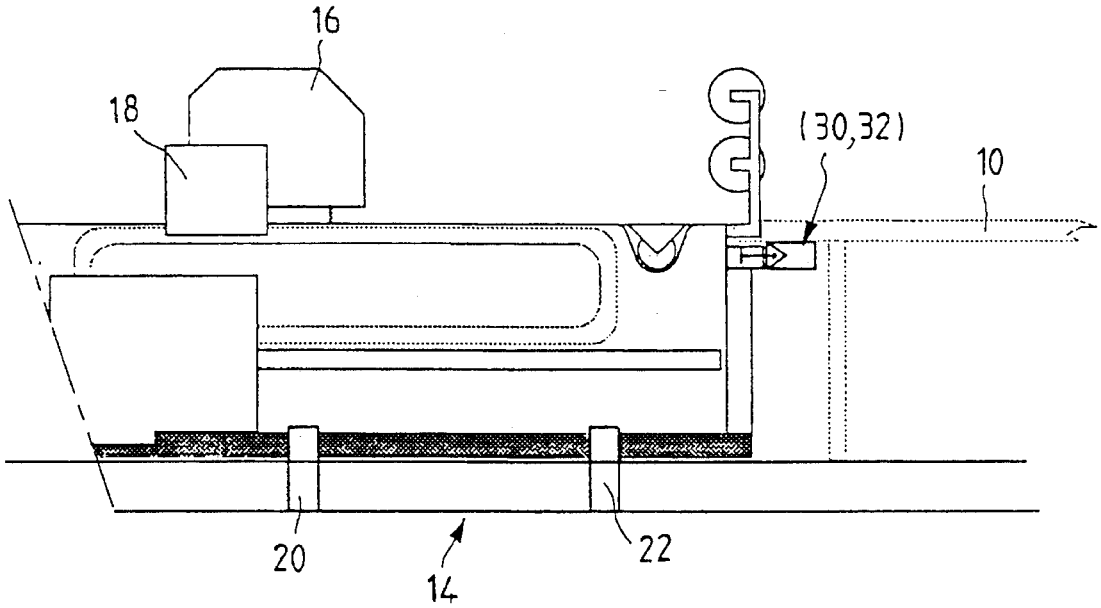
Figure 3:
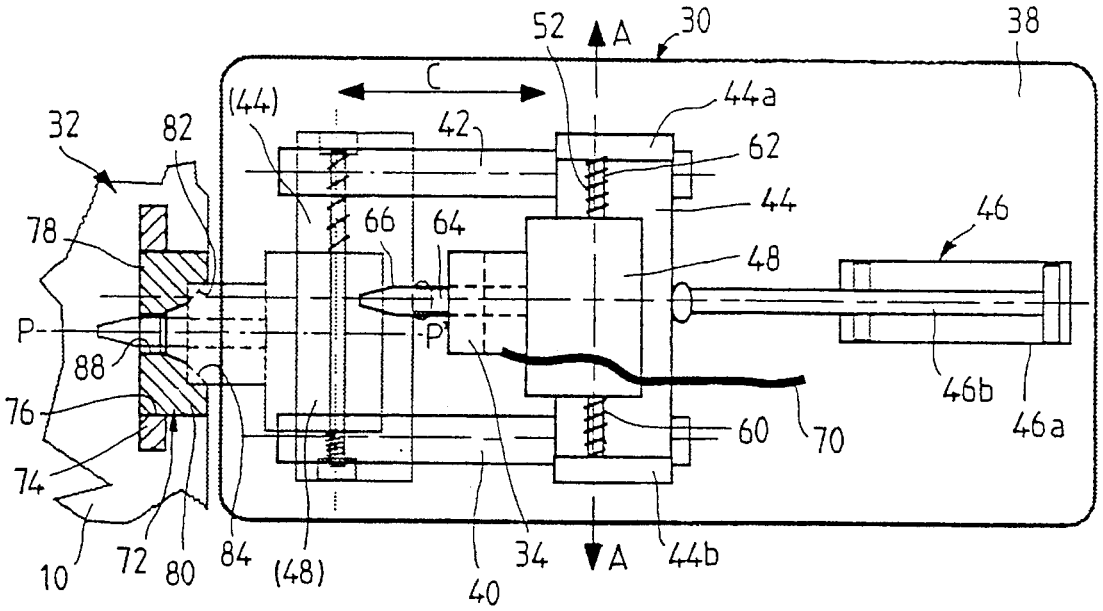
FIG. 3 is a view from beneath of the connection device.
Figure 4:
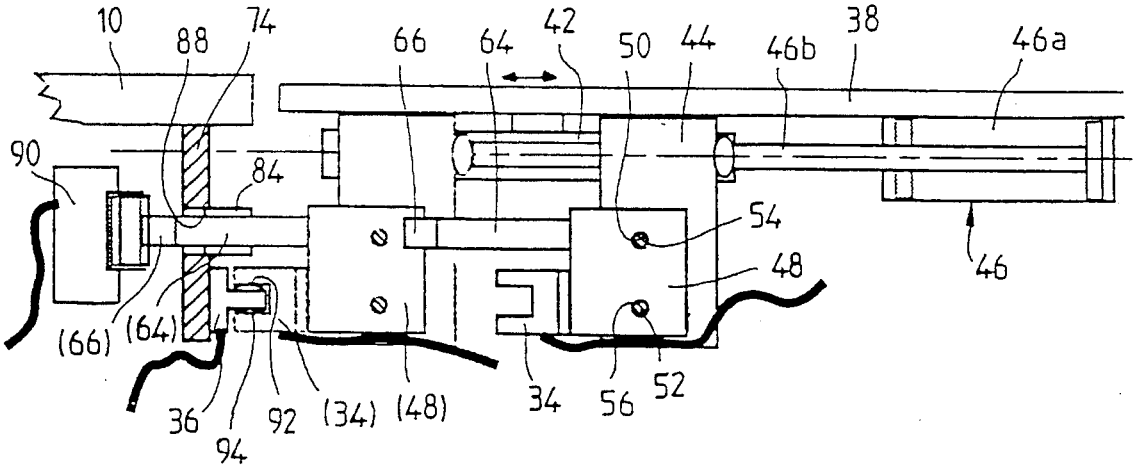
FIG. 4 is an elevation side view of the FIG. 3 connection device.

With reference now to FIGS. 3 and 4, a preferred embodiment of the connection device is described. The connection device comprises a first assembly given reference 30 and referred to below as the "moving" assembly, and a second assembly referenced 32 and referred to as the "stationary" assembly. The first assembly 30 includes the female connector 34, as can be seen in FIG. 4, while the stationary portion 32 includes the male connector 36. Nevertheless, the connection elements could naturally be installed the opposite way round. The moving assembly 30 includes a base 38 which, for example, is secured to the cutting machine 14 of FIGS. 1 and 2, while the "stationary" portion 32 is secured to each of the spreading tables 10, 12.

In the description below, the term "connection direction" is used to designate the direction marked by arrow C along which the female connection element 34 needs to be displaced in order to engage the male connection element 36. The term "adjustment direction" is used to designate the direction marked by arrow A in FIG. 3 which is orthogonal to the connection direction C and parallel to the displacement direction of the machine 14, and the female connection element 34 needs to be displaced along the adjustment direction in order to bring the two connection elements into alignment thus enabling them to be properly engaged. Two slideways 40 and 42 are mounted on the base 38 and extend parallel to the connection direction C. A first carriage 44 is slidably mounted on the slideways 42 and is thus movable relative to the base along the direction C. The carriage 44 can be displaced along the direction C under drive from a member such as an actuator 46, which is preferably double-acting. The body 46*a* of the actuator is secured to the base 38 while the end of its rod 46*b* is linked to the first carriage 44. A second carriage 48 is movably mounted in translation on the first carriage 44, the second carriage being movable relative to the first carriage along the adjustment direction A. For this purpose, two guide rods 50 and 52 parallel to the direction A and disposed in a common vertical plane (assuming that the base 32 is horizontal) have their ends secured to portions 44*a* and 44*b* of the first carriage 44. The second carriage 48 is provided with two holes 54 and 56 in which the guide rods 50 and 52 are engaged. In addition, balanced return springs 60 and 62 are engaged on guide rod 50 at least on either side of the carriage 48. Thus, under drive from these two springs, the carriage 48 is held, in the absence of outside forces, in a middle reference position. An indexing finger 64 is mounted on the second carriage 48 and extends along the connection direction C towards the stationary portion 32. The indexing finger is terminated by a tapering end 66. The second carriage 48 also carries the female connection element 34 which is itself connected to an appropriate electrical conductor 70.

The stationary assembly 32 of the connection device comprises firstly a position adjusting and centering cam 72 and the male connection element 36. The cam-forming assembly 72 is preferably constituted by a vertical plate 74 having the male connector 36 fixed thereon. An orifice 76 is pierced in the plate 74 and receives a centering system constituted by a plate 78 whose active faces 82 and 84 form two portions of vertical inclined surfaces that are symmetrical about a vertical plane PP' parallel to the connection direction C. These two sloping guide faces converge towards an orifice 88.

When it is not useful or possible to make an electrical connection for controlling the conveyor of the spreading table and the conveyor of the cutting machine, a switch 90 is mounted behind the plate 74 and is capable of being activated by the end of the indexing finger. This applies, in particular, when the spreading table is not provided with a conveyor but is provided with an air cushion system for supporting the stack. The stack is then displaced manually until it is engaged on the cutter conveyor. The blower is actuated automatically by the end of the indexing finger when the cutting machine is waiting to receive a stack.

Otherwise, when it is appropriate to establish an electrical connection, the connection device operates as follows: when the cutting machine that carries the moving portion 30 of the connection device reaches the desired position, as marked by a sensor, for example, detection of the position causes the actuator 46 to be activated. The actuator 46 pushes the first carriage 4 along the connection direction C. When the end 66 of the indexing finger 64 comes into contact with the cam-forming part 78, and assuming that there is misalignment, then the second carriage 48 is displaced by co-operation of the finger 66 with one of the inclined surfaces 82 or 84. The displacement continues until under the effect of such centering, the end of the finger penetrates into the orifice 88 that extends the inclined guide faces. In this situation, the female connector 34 is accurately aligned with the male connector 36 that is secured to the plate 74. The two connection elements can then engage mutually under very good conditions since both elements are accurately aligned.

In FIGS. 3 and 4, the carriages 44 and 48 are shown in solid lines in a rest, first position, and the same carriages are shown in dashed lines in the positions they occupy when an electrical connection is established.

The male connection element preferably includes at least two resilient members 92 and 94, which resilient members are conductive. Thus, by asymmetrical deformation of these resilient members (e.g. spring blades) it is possible to compensate for possible misalignment in a vertical direction between the "stationary" portion 32 of the connection device and the "moving" portion 30.

In the description above, it is assumed that the centering cam is constituted by two inclined faces forming a dihedral angle which is extended by a final centering orifice. Instead of using a cam of that shape, it will be possible to use a cam constituted by a portion of a frustoconical surface. Under such circumstances, the end 66 of the indexing finger 64 should naturally also constitute a portion of a truncated cone.

As mentioned above, if there is no electrical connection, a switch 90 is disposed behind the centering orifice 88. When the end of the indexing finger 64 comes into contact with the switch 90, the blower or the conveyor is started so as to transfer the stack onto the cutting machine.

It is also clear that a plurality of connectors could be provided in the connection device. All of the male connection elements would then be secured to the second carriage 48 while all of the female connection elements would then be secured to the plate 74.

In the description above, the connection device of the invention is described as applied to an installation for cutting sheet material. Naturally the device could be used in numerous other installations that require the two elements of an electrical connector to be positioned automatically and accurately.

What we claim is:

1. An electrical connection device with automatic positioning, for connecting a first and a second electrical connection elements, said connection being obtained by engaging one of the elements in other by relative displacement along a connection direction said device comprising:

a base which is fixed during the electrical connection operation;

a first moving support displaceable relative to said base relative to said base along said connection direction (C);

means for displacing said first support relative to said base along said connection direction;

a second support mounted on said first support and movable relative thereto along an adjustment direction which is orthogonal to the connection direction (C);

an indexer element secured to said second support, extending along the connection direction, and having an indexing end, said first connection element being secured to said second support; and a cam-forming assembly suitable for co-operating with the indexing end of said indexer element, said second connection element being secured to said cam-forming assembly, whereby during displacement of the first moving support, co-operation between the indexer element and the cam-forming assembly causes said second support to be displaced relative to the first support until said first connection element is properly positioned relative to the second connection element.

2. An electrical connection device according to claim 1, wherein said second support is movably mounted on said first support via resilient return means tending to maintain said second support in a predetermined position when said indexer element and said cam-forming element are not in contact.

3. An electrical connection device according to claim 1, wherein said cam-forming element comprises two guide faces which are symmetrical about a first plane parallel to the connection direction and perpendicular to said adjustement direction (A) of the second support relative to the first support, and which are orthogonal to a second plane parallel to the connection direction and to the adjustement direction of the second support relative to the first.

4. An electrical connection device according to claim 3, wherein said base is provided with slideway-forming means co-operating with said first support to guide it in translation along the connection direction, and said first support includes guide elements co-operating with said second support to guide said second support in translation along said adjustment direction.

5. An electrical connection device according to claim 4, wherein one of the electrical connection elements is provided with conductive resilient means suitable for co-operating with the other connection element to compensate for positioning error in a direction orthogonal to the connection direction and to the adjustment direction.

6. A connection device according to claim 5, wherein said displacement means comprise drive means mounted on said base to displace said first support relative to the base in the connection direction (C).

7. A connection device according to claim 6, further including an electrical member activated by the end of said indexing element and secured to said cam-forming assembly.

8. A connection device according to claim 1, said base is mounted on the cutting machine of an installation for cutting sheet material, and said cam-forming assembly is secured to a table for stacking sheets in said installation.

9. A connection device according to claim 2, wherein said resilient return means comprise two resilient assemblies mounted on either side of said second support so that said second support is held in a middle position when said indexer element and said cam-forming element are not in contact.

* * * * *